US008371042B2

(12) United States Patent
Matalon

(10) Patent No.: US 8,371,042 B2
(45) Date of Patent: Feb. 12, 2013

(54) CHILDREN'S SHOE

(75) Inventor: Michael R. Matalon, Brooklyn, NY (US)

(73) Assignee: Celebrity International, Inc., New York, NY (US)

( * ) Notice: Subject to any disclaimer, the term of this patent is extended or adjusted under 35 U.S.C. 154(b) by 551 days.

(21) Appl. No.: 12/685,832

(22) Filed: Jan. 12, 2010

(65) Prior Publication Data

US 2011/0167675 A1 Jul. 14, 2011

(51) Int. Cl.
*A43B 1/02* (2006.01)
*A43B 23/02* (2006.01)

(52) U.S. Cl. ..... 36/9 R; 36/112

(58) Field of Classification Search ..... 36/9 R, 36/112, 109, 45; 2/239, 240
See application file for complete search history.

(56) References Cited

U.S. PATENT DOCUMENTS

| | | | | | |
|---|---|---|---|---|---|
| 266,614 | A | | 10/1882 | Douglass | |
| 1,189,665 | A | | 7/1916 | Clear et al. | |
| D142,157 | S | | 8/1945 | Veach | |
| D162,189 | S | | 2/1951 | Levy | |
| 2,725,567 | A | | 12/1955 | Bevier | |
| D181,396 | S | | 11/1957 | Winter, Jr. | |
| 3,067,532 | A | * | 12/1962 | Peterson | 36/9 R |
| 3,106,790 | A | * | 10/1963 | Zimmon | 36/9 R |
| 3,299,540 | A | * | 1/1967 | Scholl | 36/8.1 |
| 3,653,074 | A | | 4/1972 | Nobile et al. | |
| D233,636 | S | | 11/1974 | Schneider | |
| 4,069,515 | A | | 1/1978 | Swallow et al. | |
| 4,149,274 | A | | 4/1979 | Garrou et al. | |
| 4,294,022 | A | | 10/1981 | Stockli et al. | |
| 4,366,629 | A | | 1/1983 | Scherz | |
| 4,562,652 | A | | 1/1986 | Hensler | |
| 4,608,716 | A | | 9/1986 | Brumfield | |
| 4,645,466 | A | | 2/1987 | Ellis | |
| 4,651,354 | A | | 3/1987 | Petrey | |
| 4,728,538 | A | | 3/1988 | Kaspar et al. | |
| 4,845,778 | A | | 7/1989 | Peterson | |
| 4,901,453 | A | | 2/1990 | Gaynor | |
| 4,907,350 | A | * | 3/1990 | Chilewich et al. | 36/19 R |
| 4,976,050 | A | | 12/1990 | Houghteling | |
| D322,881 | S | | 1/1992 | Bushman | |
| 5,133,088 | A | | 7/1992 | Dunlap | |
| D330,108 | S | * | 10/1992 | Kazapowski | D2/911 |
| 5,204,996 | A | | 4/1993 | Ehmka | |
| D347,518 | S | * | 6/1994 | Stewart | D2/920 |
| D375,616 | S | | 11/1996 | Baker et al. | |
| 5,617,585 | A | * | 4/1997 | Fons et al. | 2/239 |

(Continued)

FOREIGN PATENT DOCUMENTS

| | | | |
|---|---|---|---|
| BR | PI 0205359-4 | A | 7/2003 |
| EP | 2 022 359 | A1 | 2/2009 |

(Continued)

*Primary Examiner* — Ted Kavanaugh
(74) *Attorney, Agent, or Firm* — Cozen O'Connor

(57) ABSTRACT

An article of infant footwear comprising an upper sock portion attached to a lower sole portion. The lower sole portion comprises a toe region and a heel region. A toe region, comprising a lip portion and a toe-cap, rises up from the front of the lower sole portion to surround and protect the toes of an infant's foot. The heel region comprises a heel member to protect the heel and surrounding tendons of an infant. The lower sole portion has an underside, a protruding layer, and stud protrusions providing traction, protection, and balance for an infant wearing the article of infant footwear.

19 Claims, 4 Drawing Sheets

U.S. PATENT DOCUMENTS

| | | | | |
|---|---|---|---|---|
| 5,708,985 | A | | 1/1998 | Ogden |
| 5,737,776 | A | | 4/1998 | Jennings |
| 5,749,100 | A | | 5/1998 | Rosenberg |
| 5,926,888 | A | | 7/1999 | Chen et al. |
| D412,391 | S | | 8/1999 | Covatch |
| 6,126,671 | A | | 10/2000 | Richards et al. |
| 6,275,997 | B1 | | 8/2001 | Richardson |
| D450,427 | S | | 11/2001 | Huard et al. |
| 6,385,779 | B2 | | 5/2002 | Boersema |
| D489,516 | S | | 5/2004 | Gebhardt |
| D490,218 | S | | 5/2004 | Gebhardt |
| D517,306 | S | | 3/2006 | Hoeft |
| D571,987 | S | * | 7/2008 | Della Valle ..... D2/954 |
| D663,517 | S | * | 7/2012 | Della Valle et al. ..... D2/954 |
| 2008/0104863 | A1 | * | 5/2008 | Dreyer ..... 36/45 |

FOREIGN PATENT DOCUMENTS

| | | |
|---|---|---|
| MX | 1854 | 10/2006 |
| MX | 25971 | 2/2008 |

* cited by examiner

CHILDREN'S SHOE

REFERENCE TO RELATED APPLICATION

This application claims priority of U.S. Design patent application Ser. No. 29/342,955, filed on Sep. 3, 2009, which content is hereby incorporated by reference.

BACKGROUND OF THE INVENTION

The present invention relates generally to an article of footwear for infants and, in particular, to an article of footwear designed to better protect the entire toe region of an infant walking on both indoor and outdoor surfaces.

Infants need protection for their feet as they begin to learn to walk. This is especially the case for the more fragile areas of infants' feet, particularly their toes, as infants transition to walking from crawling, where they are more accustomed to applying pressure to their toes, and in different ways. As infants progress further to walking on outdoor terrain, it is desirable for infants to wear footwear that can be worn on both indoor and outdoor surfaces, and which provides the necessary stability and traction for such purposes.

There is a variety of infant sock and footwear present in the prior art. Such prior art generally fits into two categories: first, socks or other soft footwear primarily intended to be worn indoors by crawling infants, and second, more rigid outdoor footwear.

Infant socks or soft footwear in the prior art provide virtually no protection for an infant's toes, often only covering such areas with a soft sock material or the relatively soft upper portion of a shoe. They are also primarily designed for crawling infants, and, as a result, lack the necessary sole or other structure to enable infants to walk on outdoor surfaces with sufficient traction and protection. The infant socks or soft footwear in the prior art, therefore, invariably need to be replaced or covered with outdoor footwear as they are unsuitable for walking on outdoor surfaces without utilizing some variety of outer footwear. Infant outdoor footwear designs, by the same token, often also provide little protection for an infant's toes, and are also unsuitable for walking on indoor surfaces because they are either overly rigid or are damaging to, or leave behind undesired scrape residues on, more delicate indoor surfaces. Infant footwear often therefore needs to be removed when an infant walks indoors. In short, neither type of design sufficiently protects an infant's toes, nor are they capable of being utilized independently of the other as infants transition between indoor and outdoor environments.

U.S. Pat. No. 6,385,779 is an infant sock employing a rubber gripper member on the underside and around the front of the design. The objective of this design is to provide crawling infants with greater friction between their feet and indoor flooring. The referenced prior art provides no significant protection for the infants' toes, is not suitably designed for walking infants, and is impractical for infants walking on outdoor surfaces.

Although in general, the contributions of the prior art to infants' footwear needs has been satisfactory, the prior art has been found to not sufficiently protect the toes of walking infants or be practical for walking on both indoor and outdoor surfaces. It is therefore desirable to provide an article of infant footwear that better protects an infant's entire toe region, and which is specifically targeted towards walking infants, for walking on both indoor and outdoor surfaces.

SUMMARY OF THE INVENTION

Accordingly, it is an object of the present invention to provide a new and improved article of infant footwear for walking infants that protects the entire toe region of a walking infant's foot.

It is a further object of the present invention to provide a new and improved article of infant footwear that provides improved stability and traction for infants walking on both indoor and outdoor surfaces.

Briefly, in accordance with the present invention, these and other objects are obtained by providing an article of infant footwear that primarily consists of two portions, an upper sock portion, and an attached lower sole portion.

The upper sock portion is preferably made of a fabric that is breathable, flexible, and stretchable, providing increased flexibility and comfort for an infant's foot. For example, the instant article of infant footwear can be folded, enabling easier storage, unlike more rigid footwear for walking infants.

The lower sole portion is preferably made of a soft but durable rubber. As such, it enhances the flexibility of the article of infant footwear. Designed primarily for walking infants, the article of infant footwear's lower sole portion surrounds the lower half of the article of infant footwear, and comprises an underside, two side portions, a toe region, and a heel region at the front and rear of the of the article of infant footwear respectively. The toe region comprises a lip portion and a toe-cap, which meet to form a closed end. The toe-cap is structured and arranged to cover the Distal Phalange bones, Middle Phalange bones, and preferably the Proximal Phalange bones of an infant's foot. The heel region comprises a heel portion, which is formed by the rear of the lower sole portion rising from the underside, and is preferably structured and arranged to cover and protect the Calcaneus bone and the lower extremity of the Calcaneus (Achilles) Tendon of an infant's foot. The two side portions are molded around the lateral sides of the article of infant footwear and connect the toe region to the heel region. Protection for these areas of an infant's foot, particularly the toes, is especially important during the early stages of an infant's walking development.

A plurality of stud protrusions preferably cover the entire lower sole portion of the article of infant footwear, except for the toe-cap. The stud protrusions are intended to provide increased traction for walking on indoor and outdoor surfaces. The stud protrusions are preferably made of the same flexible rubber as the lower sole portion to provide improved traction against different types of surfaces without damaging or leaving undesired scrape residues on such surfaces. The underside of the lower sole portion possesses additional improved stabilizing features, including a protruding layer in the shape of the underside of the lower sole portion to provide greater stability. The protruding layer features stud protrusions positioned at shorter distances from each other than is evident on the remainder of the lower sole portion, giving even greater traction and stability to walking infants applying pressure in different directions as they walk. An insole is located inside the article of infant footwear to provide additional stability and comfort.

The present invention is a novel improvement over the prior art because while the prior art teaches many different varieties of socks and footwear for infants, none of the prior art teaches an article of infant footwear offering sufficient protection for the entire toe region of walking infants in the form of a raised lip portion and toe-cap, and furthermore none of the prior art teaches an article of infant footwear offering such protection coupled with the increased flexibility, stability and traction necessary for the relative requirements of walking on indoor and outdoor surfaces.

BRIEF DESCRIPTION OF THE DRAWINGS

The above, as well as other advantages of the present invention, will become readily apparent to those skilled in the art from the following detailed description of a preferred, embodiment when considered in the light of the accompanying drawings in which.

Figure 1:
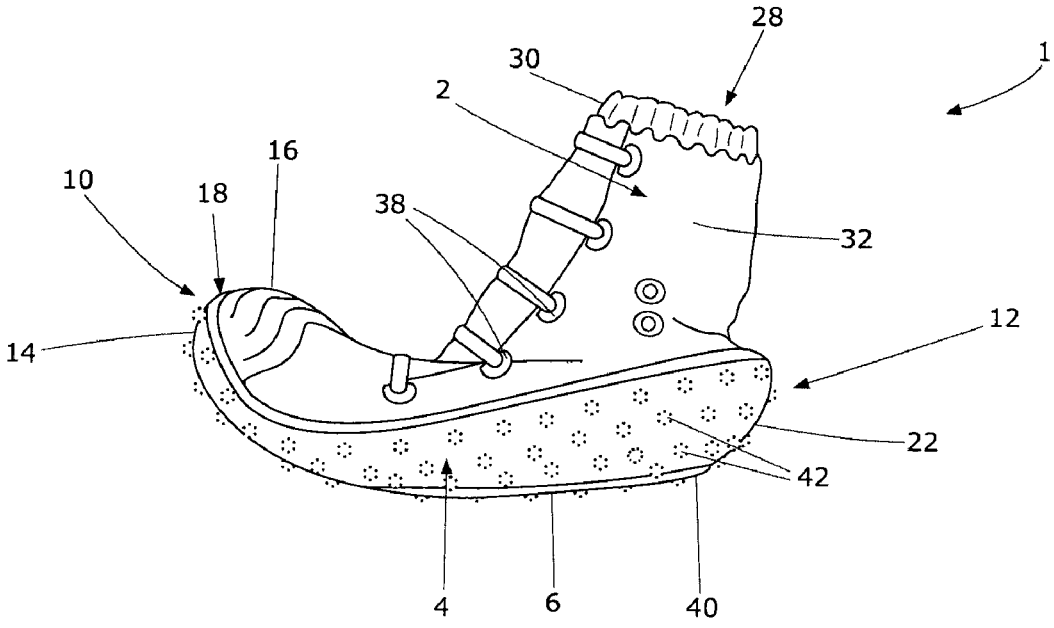
FIG. 1 is a side view of an article of infant footwear in accordance with the present invention.

A more complete appreciation of the invention and many of the attendant advantages thereof will be understood by reference to the following detailed description when considered in conjunction with the accompanying drawings.

DESCRIPTION OF THE PREFERRED EMBODIMENT

Referring now to the drawings wherein like reference numerals designate identical or corresponding parts throughout the several views, an article of infant footwear according to the present invention, generally indicated at 1, comprises an upper sock portion 2 attached to a lower sole portion 4. The upper sock portion 2 is preferably made of a natural and stretchable fabric material, such as cotton, polyester, nylon, or a synthetic stretchable fabric material, such as Lycra® (E. I. du Pont de Nemours and Co., 1007 Market Street, Wilmington, Del. 19898) or spandex. In the illustrated embodiment, the lower sole portion 4 is made of rubber, but could also be made of leather, or any other flexible and wear-resistant material. The rubber lower sole portion 4 is preferably made by injection molding, though other techniques could be used. The lower sole portion 4 is structured and arranged to provide the greatest possible traction and stability for the infant wearing the article of infant footwear.

Figure 6:
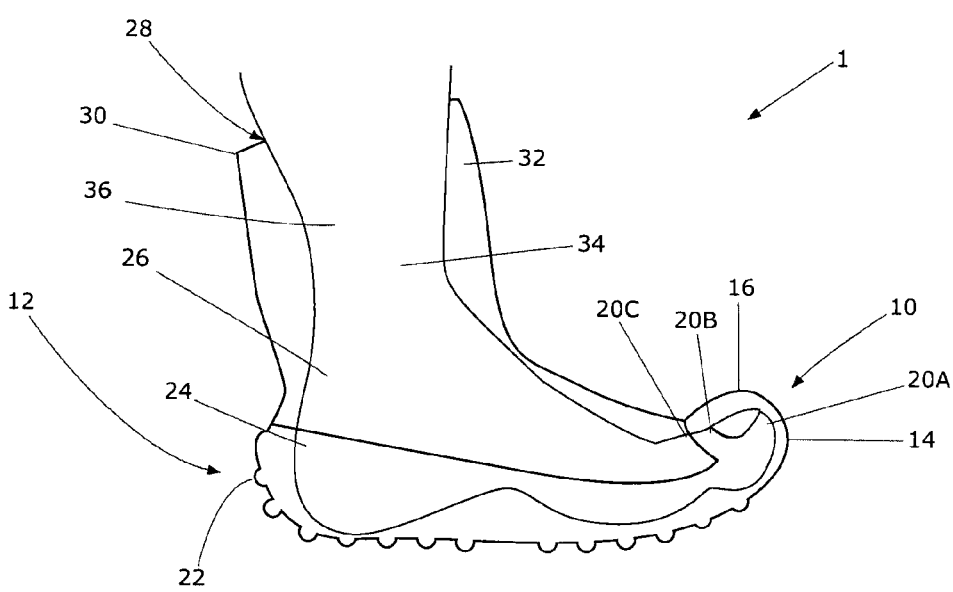
FIG. 6 is a side elevation view of an article of infant footwear in accordance with the present invention with a foot visible therein.
Figure 7:
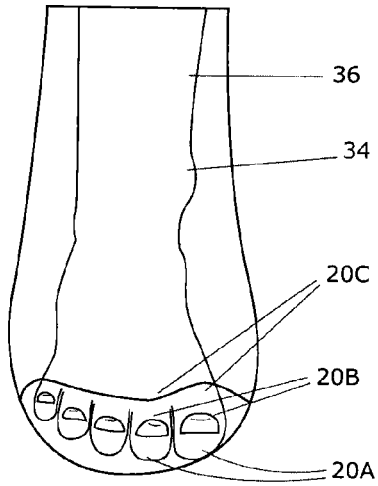
FIG. 7 is a front view of an article of infant footwear in accordance with the present invention with a foot visible therein.

The upper sock portion 2 and lower sole portion 4 may be stitched, glued, or integrally molded together. The lower sole portion 4 comprises an underside 6, two side portions 8, a toe region 10, and a heel region 12 at the front and rear respectively of the lower sole portion 4. The toe region 10 comprises a lip portion 14, and a toe-cap 16, which meet to form a closed end 18. Referring to FIGS. 6 and 7, the front of the lower sole portion 4 rises from the underside to form the lip portion 14, which is structured and arranged to cover the front of the Distal Phalange bone portions 20(A) of all of the toes of the child's foot. As shown in FIGS. 6 and 7, the lip portion 14 is joined to the toe-cap 16, which retreats from where it joins with the lip portion 14 to progressively cover additional areas of all of the toes of the walking infant, including the Distal Phalange bone portion 20(A), Middle Phalange bone portion 20(B), and preferably, depending on the size of an infant's toes, the Proximal Phalange bone portion 20(C) of an infant's toes (all shown generally in FIG. 7). The heel region 12 comprises a heel portion 22, which is formed by the rear of the lower sole portion 4 rising from the underside 6, and is preferably structured and arranged to cover the Calcaneus bone portion 24 of an infant's foot, and the portion of the foot containing the lower extremity of the Calcaneus (Achilles) Tendon 26. The two side portions 8 of the lower sole portion 4 are molded around the lateral sides of the article of infant footwear and connect toe region 10 to the heel region 12.

The upper sock portion comprises an open end 28. The open end comprises a rim 30 and a sleeve 32, which are structured and arranged to receive and grip the ankle region 34 of an infant's foot. The rim 30 contains elastic and has a diameter that is less than the diameter of the sleeve 32 and the remainder of the upper sock portion 2 for grasping and securing an infant's foot. The upper sock portion 2 is sized to cover an infant's ankle region 34 and the lower extremities of the Fibula and Tibia bone portions 36 of an infant's lower leg.

The upper sock portion 2 may have graphics printed thereon to mimic the appearance of a shoe. Specifically, the upper sock portion 2 comprises images 38 of features of the upper portion of a sneaker, including, preferably, laces, lace holes and compartments, and other stitching components found on sneakers to add to the aesthetics of the article of infant footwear.

Figure 2:
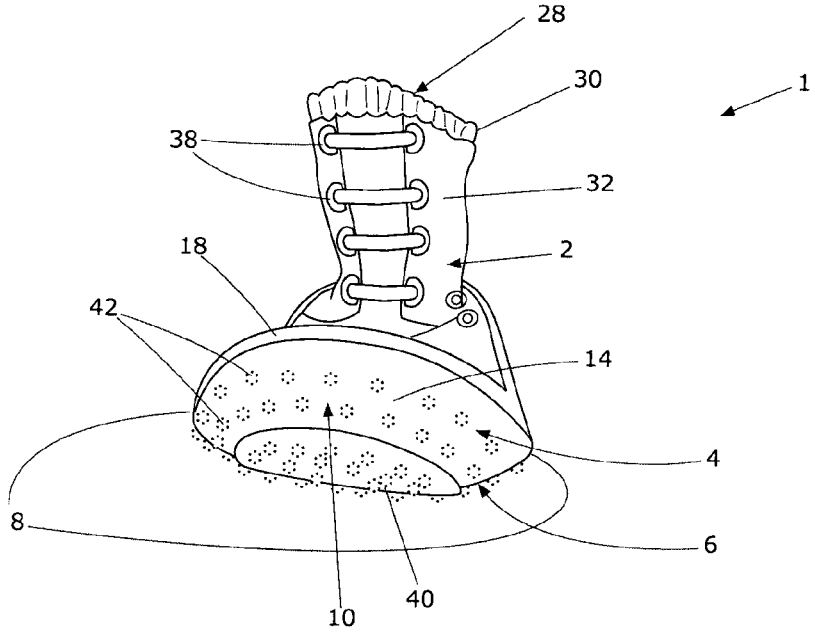
FIG. 2 is a front view of the article of infant footwear shown in FIG. 1.
Figure 3:
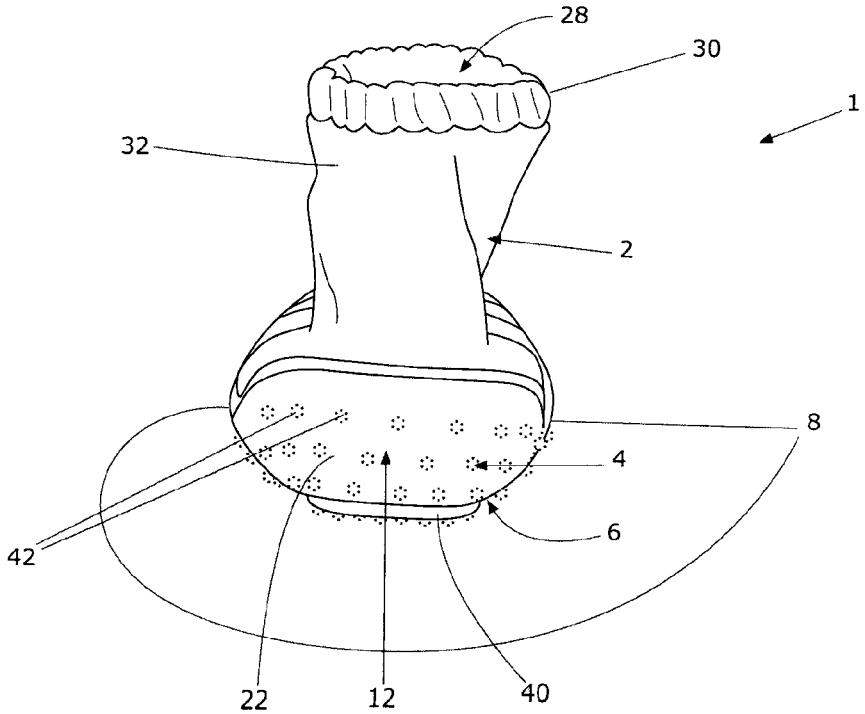
FIG. 3 is a rear view of the article of infant footwear shown in FIGS. 1 and 2.
Figure 4:
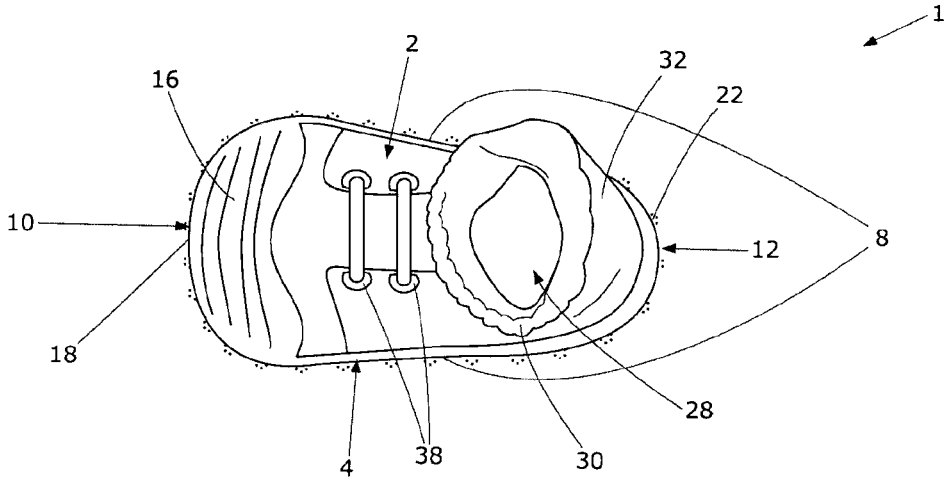
FIG. 4 is a top plan view of the article of infant footwear shown in FIGS. 1, 2 and 3.
Figure 5:
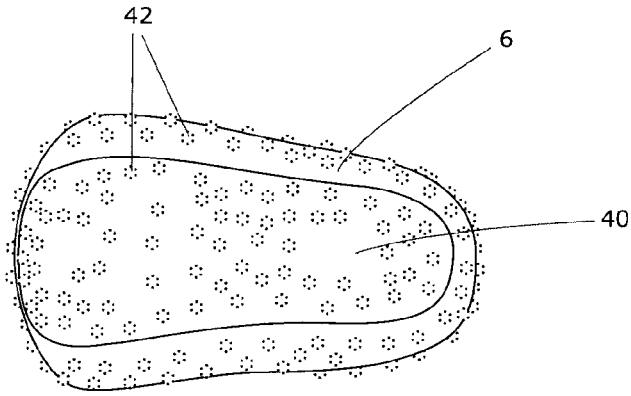
FIG. 5 is a bottom plan view of the article of infant footwear shown in FIGS. 1, 2, 3 and 4.

The underside 6 of the lower sole portion 4 includes a protruding layer 40, generally following the same shape as the underside 6, but which is smaller in size than the underside 6, and which is preferably also made of rubber. The entire lower sole portion 4, except for the toe-cap 14, also includes a plurality of stud protrusions 42, preferably made of the same rubber as the lower sole portion 4, providing greater traction and stability for an infant wearing the article of infant footwear 1. The stud protrusions 42 are closer to each other on the protruding layer 40, as shown in FIGS. 2, 3 and 5, than on the remainder of the lower sole portion 4, namely the lip portion 12, underside 6, two side portions 8 and heel portion 24. The toe-cap 14 does not feature the stud protrusions 42 as it is not necessary for a walking infant to make contact with the ground using the toe-cap 14. An insole 44 is located inside the article of footwear to provide additional stability and support.

Obviously, numerous modifications and variations of the present invention are possible in the light of the above teachings. It is therefore to be understood that within the scope of the appended claims the invention may be practiced otherwise than as specifically described therein.

What is claimed is:

1. An article of children's footwear for walking infants, comprising:

an upper sock portion sized to fit the foot of a walking infant, said sock portion formed of a fabric material, a lower sole portion formed of a rubber material attached to said upper sock portion, said lower sole portion comprising an underside, two side portions, a heel region and a toe region;

said toe region of said lower sole portion including a lip portion which rises from a front of the underside of said lower sole portion and structured and arranged to cover the front of all of the toes of a foot of a walking infant and a toe-cap extending from said lip portion structured and arranged to cover the top of all of the toes of a foot of a walking infant, and wherein said lip portion and toe-cap are structured and arranged to surround and protect all of the toes of a foot of a walking infant and, wherein said lower sole portion provides traction against and protection from the ground and balance for a walking infant wearing said article of footwear, wherein said underside comprises a protruding layer having the same shape of the lower sole portion, and being smaller in size than said lower sole portion, to stabilize a walking infant wearing said article of footwear.

2. The article of footwear according to claim 1, wherein said lip portion and toe-cap are joined to said upper sock portion to form a closed end.

3. The article of footwear according to claim 1, wherein said toe-cap is structured and arranged to cover the top of the Distal, Middle, and Proximal Phalange bones of a walking infant.

4. The article of footwear according to claim 1, wherein said heel region comprises a heel portion rising from the rear of said lower sole member.

5. The article of footwear according to claim 4, wherein said heel portion is structured and arranged to cover the Calcaneus bone and the start of the Calcaneus (Achilles) Tendon of a walking infant.

6. The article of footwear according to claim 1, wherein said upper sock portion comprises a stretchable fabric.

7. The article of footwear according to claim 1, wherein said two side portions of said lower sole portion connect said toe region with said heel region.

8. The article of footwear according to claim 1, wherein said upper sock portion comprises an open end.

9. The article of footwear according to claim 8, wherein said of said open end is structured and arranged to receive the foot of a walking infant.

10. The article of footwear according to claim 1, wherein said upper sock portion comprises a rim and a sleeve.

11. The article of footwear according to claim 10, wherein said rim has a diameter less than that of said sleeve to receive and grip the ankle region of a walking infant.

12. The article of footwear according to claim 1, wherein said upper sock portion further comprises printed graphics to mimic the appearance of a shoe.

13. The article of footwear according to claim 1, wherein said upper sock portion is stitched to said lower sole portion.

14. The article of footwear according to claim 1, wherein said upper sock portion is attached to said lower sole portion with glue.

15. The article of footwear according to claim 1, wherein said upper sock portion is integrally molded to said lower sole portion.

16. The article of footwear according to claim 1, wherein said lower sole portion further comprises a plurality of spaced-apart stud protrusions covering the entirety of said lower sole portion.

17. The article of footwear according to claim 16, wherein said stud protrusions are made of rubber to provide traction against the ground.

18. The article of footwear according to claim 16, wherein said stud protrusions on said underside are spaced-apart from each other at a smaller distance than said stud protrusions located on the remainder of said lower sole portion, providing greater traction and stability.

19. The article of footwear according to claim 1, further comprising an insole positioned inside said article of footwear, said insole having the shape of the inside of said article of footwear.

* * * * *